US009282617B2

(12) United States Patent
Lin

(10) Patent No.: US 9,282,617 B2
(45) Date of Patent: Mar. 8, 2016

(54) ILLUMINATION SYSTEM AND PHASE SIGNAL TRANSMITTER OF THE SAME

(71) Applicants: HEP TECH CO., LTD., Taichung (TW); Ming-Feng Lin, Taichujng (TW)

(72) Inventor: Ming-Feng Lin, Taichung (TW)

(73) Assignees: HEP TECH CO., LTD., Taichung (TW); Ming-Feng Lin, Taichung (TW)

( * ) Notice: Subject to any disclaimer, the term of this patent is extended or adjusted under 35 U.S.C. 154(b) by 0 days.

(21) Appl. No.: 14/447,307

(22) Filed: Jul. 30, 2014

(65) Prior Publication Data

US 2015/0077011 A1 Mar. 19, 2015

(30) Foreign Application Priority Data

Sep. 18, 2013 (TW) ..... 102217624 U

(51) Int. Cl.
*H05B 41/16* (2006.01)
*H05B 37/02* (2006.01)
*H05B 33/08* (2006.01)

(52) U.S. Cl.
CPC ..... *H05B 37/0209* (2013.01); *H05B 33/0845* (2013.01); *H05B 37/0263* (2013.01)

(58) Field of Classification Search
USPC ..... 323/319, 320, 300; 315/291, 200 R, 315/209 R, 246
See application file for complete search history.

(56) References Cited

U.S. PATENT DOCUMENTS

| | | | | |
|---|---|---|---|---|
| 2011/0012530 | A1 * | 1/2011 | Zheng et al. | 315/294 |
| 2013/0076248 | A1 * | 3/2013 | Shimizu et al. | 315/127 |
| 2013/0195490 | A1 * | 8/2013 | Iritani | 399/67 |
| 2013/0221871 | A1 * | 8/2013 | King et al. | 315/254 |

* cited by examiner

*Primary Examiner* — Minh D A
(74) *Attorney, Agent, or Firm* — Ming Chow; Sinorica, LLC

(57) ABSTRACT

An illumination system includes an input interface, a phase angle control module, a lamp, and a driving module. The input interface is controllably switched between a first state and a second state. The phase angle control module is electrically connected to an AC power source and the input interface. When the input interface is at the first state, the phase angle control module modifies a voltage waveform of the AC power source to generate a delayed conduction angle in a half wave period of the voltage waveform. The driving module is stored with a control mode, wherein the driving module switches the control mode to control the lamp to emit light in accordance with the delayed conduction angle.

18 Claims, 12 Drawing Sheets

ILLUMINATION SYSTEM AND PHASE SIGNAL TRANSMITTER OF THE SAME

The current application claims a foreign priority to the patent application of Taiwan No. 102217624 filed on Sep. 18, 2013

BACKGROUND OF THE INVENTION

1. Technical Field

The present invention relates generally to controlling of lamps, and more particularly to an illumination system and a signal transmitter of the illumination system.

2. Description of Related Art

Typically, indoor electricity wiring is installed by providing two wires between an electricity box on the ceiling and another electricity box in the wall, wherein the two wires are connected to a switch. To install an electric apparatus (such as a lamp, an electric fan), the electric apparatus is fixed on the ceiling and connected to an end of mains electricity, while the other end of mains electricity is connected to a switch through the wires, and connected back to the electric apparatus to form a power loop. In this way, the electric apparatus can be turned on and off simply by switching the switch.

Because of the advancement of technology, electric apparatuses nowadays provide various functions. For example, the luminance and light color of a commonly seen LED (light-emitting diode) illumination system are usually adjustable now. In order to transmit control signals which are related in performing such functions, the LED illumination system may need additional control wiring other than the power loop to transmit the control signals from, say, a control panel on the wall to a LED module.

In other words, additional control wiring seems necessary for LED illumination systems which have functions of adjusting luminance and light color, because control signals may have to be transmitted through control wiring to a LED module. However, additional control wiring inevitably increases the cost for home maintenance or home decoration.

There are two conventional ways to transmit control signals without installing additional control wiring, which are by means of wireless transmission and carrier transmission. The wireless way requires wireless transceivers respectively installed at the LED module and the control panel on the wall, and the control signals for controlling the LED module can be transmitted wirelessly. As to the carrier way, there has to be a modulator to convert control signals into frequency-modulated signals or amplitude-modulated signals, and the converted signals are carried through power line. The LED module can be controlled after the converted signals being recovered with a demodulator.

Either way requires expensive equipment, and wireless transceivers and modulators still need additional power wiring too, which is kind of bothersome. Furthermore, signals transmitted by means of wireless transmission or carrier transmission tend to be interfered by other wireless signals, and it even creates more trouble to comply with EMI and EMS regulations of different countries.

BRIEF SUMMARY OF THE INVENTION

In view of the above, the primary objective of the present invention is to provide an illumination system and a phase signal transmitter, which can transmit signals with the wiring of a conventional power loop.

The illumination system of the present invention includes an input interface, a phase angle control module, a lamp, and a driving module. The input interface is controllably switched between a first state and a second state. The phase angle control module is electrically connected to an AC power source and the input interface, wherein when the input interface is at the first state, the phase angle control module modifies a voltage waveform of the AC power source to generate a delayed conduction angle in a half wave period of the voltage waveform of the AC power source. The lamp is controllable to emit light. The driving module is electrically connected to the phase angle control module and the lamp, wherein the driving module is stored with a control mode, which includes a default illumination mode and a luminance adjusting mode, and the driving module switches the control mode in accordance with the delayed conduction angle generated by the phase angle control module; if the control mode is switched to the default illumination mode, the lamp is driven to emit light with a default luminance; if the control mode is switched to the luminance adjusting mode, the lamp is driven to emit light with a variable luminance which is repeatedly and continuously regulated between a first luminance and a second luminance until the input interface is switched again, wherein the variable luminance at this time point of the input interface being switched is recorded to update the default luminance, and then the lamp is driven to emit light with the newly updated default luminance.

The present invention further provides an illumination system, which includes an adjustable resistor, a phase angle control module, a lamp, and a driving module. The adjustable resistor is controllable to adjust a resistance thereof. The phase angle control module is electrically connected to an AC power source and the adjustable resistor, wherein the phase angle control module modifies a voltage waveform of the AC power source to generate a delayed conduction angle in a half wave period of the voltage waveform of the AC power source in accordance with the resistance of the adjustable resistor, and the delayed conduction angle has different degree in accordance with different resistance of the adjustable resistor. The lamp is controllable to emit light. The driving module is electrically connected to the phase angle control module and the lamp to convert power provided by the AC power source which passes through the phase angle control module into electric signals to drive the lamp, wherein the driving module drives the lamp to emit light in accordance with the degree of the delayed conduction angle generated by the phase angle control module.

The present invention provides a phase signal transmitter, which is provided between an AC power source and a lamp. The phase signal transmitter includes a switch, a phase angle control module, and a driving module. The switch is controllably switched between a short state and an open state. The phase angle control module is electrically connected to the AC power source and the switch, wherein when the switch is at the short states, the phase angle control module modifies a voltage waveform of the AC power source to generate a delayed conduction angle in a half wave period of the voltage waveform of the AC power source; when the switch is at the open states, the delayed conduction angle is not generated in the voltage waveform. The driving module is connected to the phase angle control module and the lamp, wherein the driving module generates electrical signals to control the lamp to emit light in accordance with the delayed conduction angle generated by the phase angle control module.

The present invention further provides a phase signal transmitter which is provided between an AC power source and a lamp. The phase signal transmitter includes an adjustable resistor, a phase angle control module, and a driving module. The adjustable resistor is controllable to adjust a resistance thereof. The phase angle control module is electrically connected to an AC power source and the adjustable resistor, wherein the phase angle control module modifies a voltage waveform of the AC power source to generate a delayed conduction angle in a half wave period of the voltage waveform of the AC power source in accordance with the resistance of the adjustable resistor, and the delayed conduction angle has different degrees in accordance with different resistance of the adjustable resistor. The driving module is electrically connected to the phase angle control module and the lamp, wherein the driving module generates electrical signals to control the lamp to emit light in accordance with the degree of the delayed conduction angle generated by the phase angle control module.

Whereby, signals can be transmitted with the wiring of a conventional power loop. Therefore, it is not necessary to install additional control wiring, and therefore the cost of wiring is effectively reduced.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
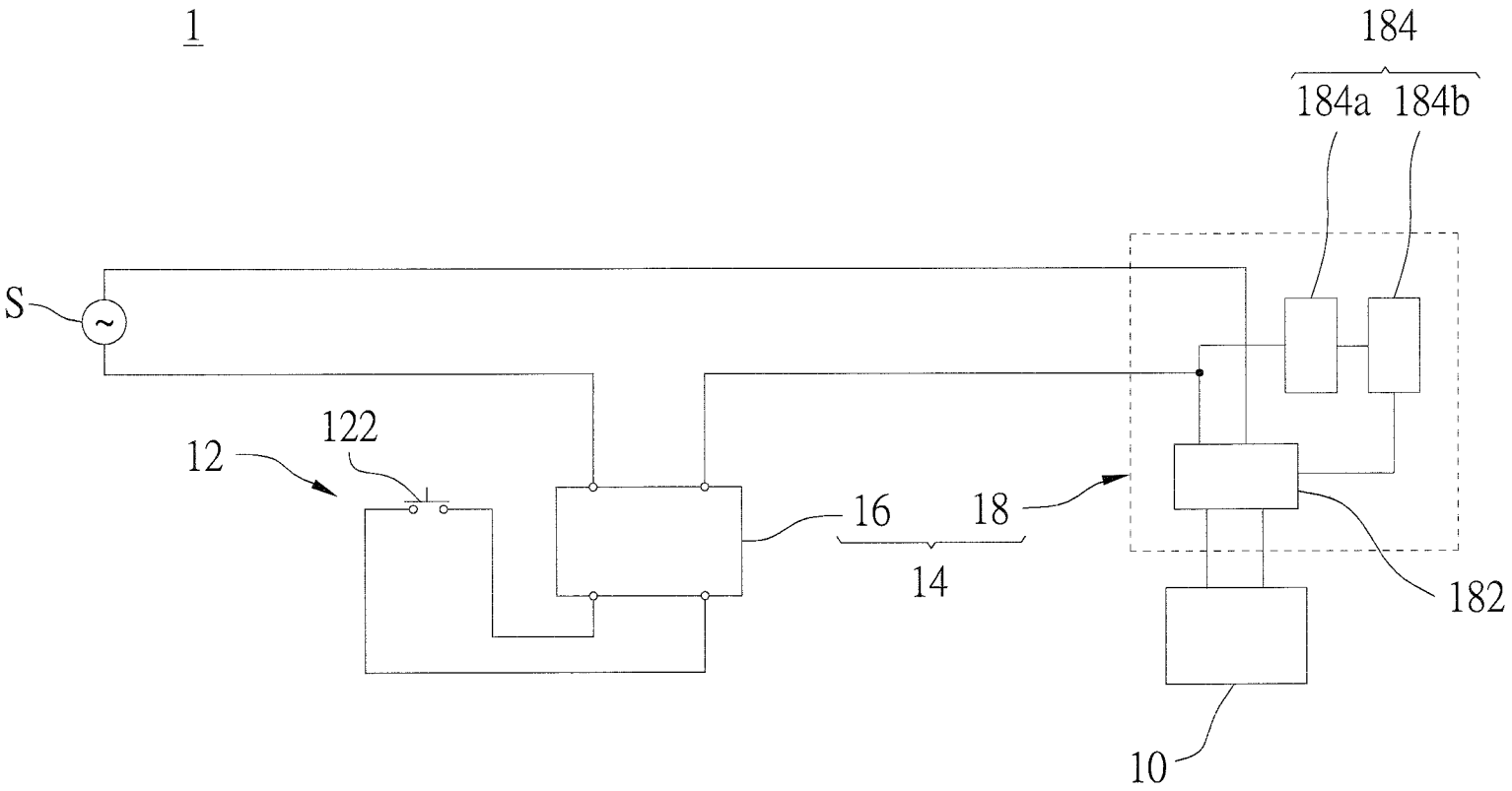
FIG. 1 is a block diagram of the illumination system of a first preferred embodiment of the present invention.

As shown in FIG. 1, a LED illumination system 1 of the first preferred embodiment of the present invention includes a LED module 10, an input interface 12, and a phase signal transmitter 14, wherein the LED module 10 could be replaced with other loadings in other embodiments.

The LED module 10 has a plurality of LEDs, which receive electric signals to emit light and provide illumination. The input interface 12 includes a switch 122, wherein the switch 122 is a normally open push switch. In the first preferred embodiment, the switch 122 is activated (short) by being pressed, and the switch 122 is defined to be at a first state while being pressed. On the contrary, the switch is defined to be at a second state if not pressed.

The phase signal transmitter 14 includes a phase angle control module 16 and a driving module 18, wherein the phase angle control module 16 is electrically connected to an AC power source S and the switch 122, and the phase angle control module 16 detects whether the switch 122 is at the first or the second states. If the switch 122 is pressed and therefore activated (i.e. the input interface 12 is switched to the first state), the phase angle control module 16 modifies a voltage waveform of the AC power source S to make the voltage waveform have a delayed conduction angle in its positive half wave periods. In contrast, once the switch 122 is not pressed, the input interface 12 automatically returns back to the second state, and the voltage waveform is no longer being modified by the phase angle control module 16. In other words, the voltage waveform has no delayed conduction angle therein. In order to reduce harmonic of the AC power source S and not to lower power factor too much, the delayed conduction angle is preferable to be no greater than 90 degrees.

Figure 2A:
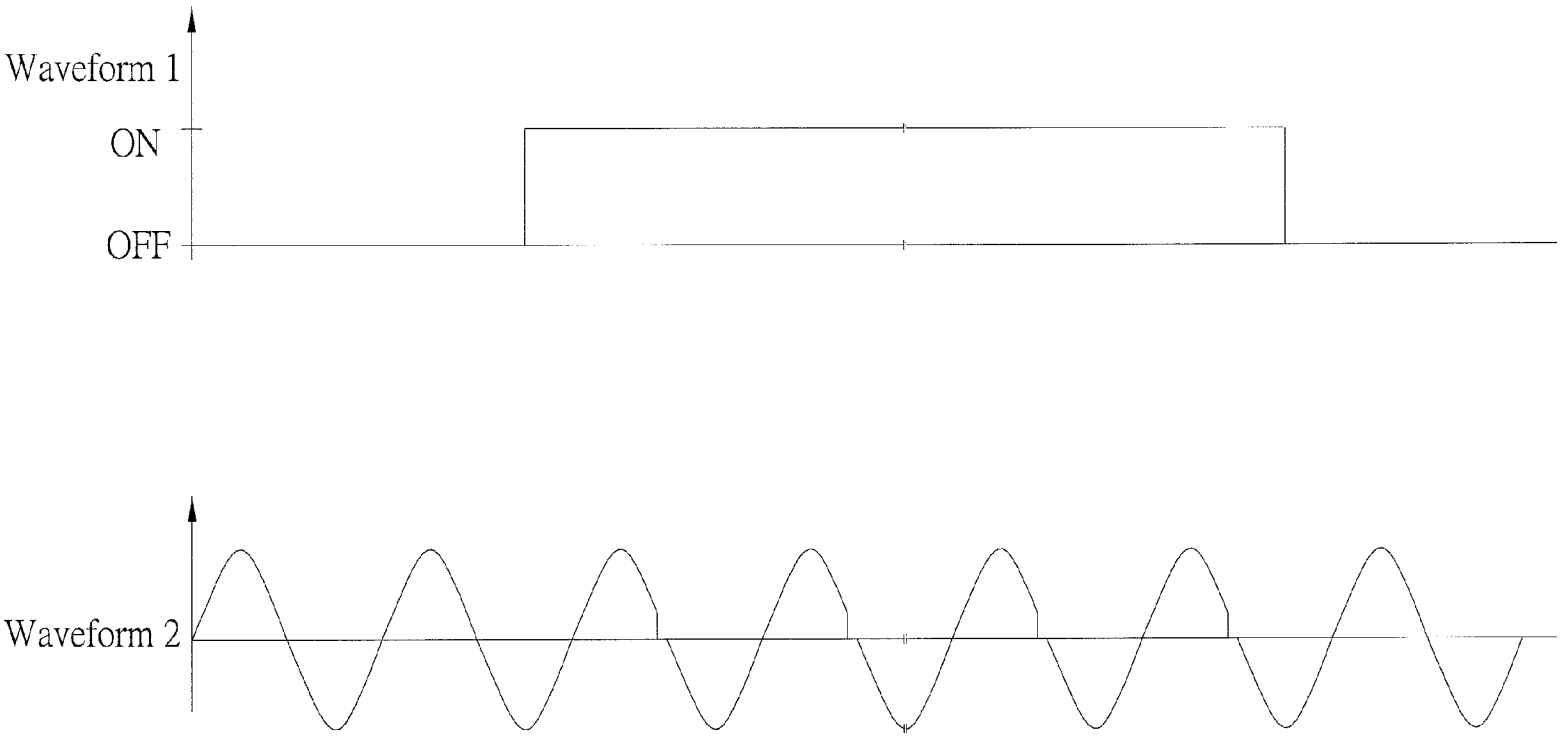
FIG. 2A is a oscillogram, showing the delayed conduction angle is generated at the rear end of each positive half-wave if the switch is activated.
Figure 2B:
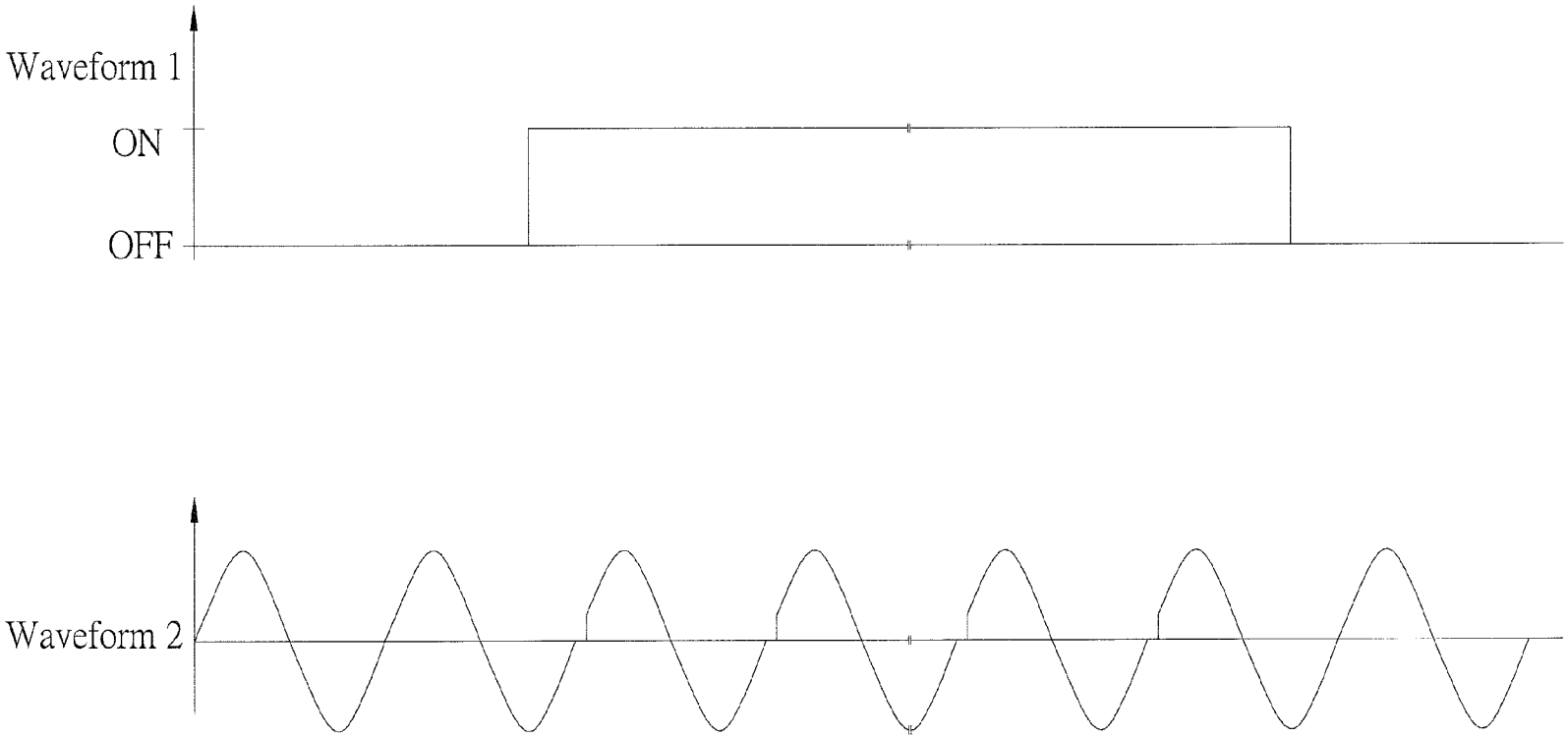
FIG. 2B is a oscillogram, showing the delayed conduction angle is generated at the front end of each positive half-wave if the switch is activated.

In the first preferred embodiment, if the switch 122 is pressed (as waveform 1 shown in FIG. 2A), the phase angle control module 16 modifies the voltage waveform of the AC power source S to generate a delayed conduction angle at a rear end of a positive half-wave of each of the outputted voltage waveforms (as waveform 2 shown in FIG. 2A). In practice, the delayed conduction angle can be alternatively generated at a front end of the positive half-wave, as shown in FIG. 2B. Of course, the delayed conduction angle can also be generated at a rear or a front end of a negative halt-wave, since the delayed conduction angle can be seen as an indication to indicate that the switch 122 is being pressed in any of the aforementioned ways.

The driving module 18 includes a power conversion circuit 182 and a control unit 184 which are electrically connected to each other. The power conversion circuit 182 is electrically connected to the phase angle control module 16 and the LED module 10, to receive electric power flowing through the phase angle control module 16 and convert it into the electric signals which meet the requirement of the LED module 10. The power conversion circuit 182 is controllable to switch the LED module 10 on or off, and to regulate its luminance. In the first preferred embodiment, the design of the power conversion circuit 182 is based on a pulse width modulation circuit, and therefore the power conversion circuit 182 can modify a clocking of the electric signals provided to the LED module 10 by modulating pulse width. Of course, the power conversion circuit 182 can be designed to have the function of modifying intensity of the electric signals in practice.

The control unit 184 includes a phase angle detecting circuit 184*a* and a processor 184*b*. The phase angle detecting circuit 184*a* is electrically connected to the phase angle control module 16 to detect if the voltage waveform contains the delayed conduction angle, and measure the degree of the delayed conduction angle if so. The result of such detection is transmitted to the processor 184*b*, which is stored with a control mode. The control mode includes a maximum illumination mode, a default illumination mode, and a luminance adjusting mode. The control mode is switched to control the electric signals provided by the power conversion circuit 182 to drive the LED module 10 to emit light. The result of detecting the delayed conduction angle with the phase angle detecting circuit 184*a* is a basis for determining which state the input interface 12 is at.

In more details, the maximum illumination mode controls the power conversion circuit 182 to drive the LED module 10 to emit light with a maximum luminance, which is a highest luminance achievable for the LED module 10 to be operated under a rated power thereof.

The default illumination mode controls the power conversion circuit 182 to drive the LED module 10 to emit light with a default luminance. In the first preferred embodiment, the default luminance is half of the maximum luminance by default, and can be modified in the luminance adjusting mode.

The luminance adjusting mode controls the power conversion circuit 182 to drive the LED module 10 to emit light with a variable luminance, which is repeatedly and continuously regulated between a first luminance and a second luminance until the processor 184*b* finds out that the input interface 12 is switched into the second state. The variable luminance at this time point is recorded to update the default luminance under the default illumination mode, and the LED module 10 is driven to emit light with the newly updated default luminance. In the first preferred embodiment, the first luminance is the maximum luminance, and the second luminance is a minimum luminance that the LED module 10 could provide. In practice, the processor 184*b* can alternatively control the power conversion circuit 182 to drive the LED module 10 to emit light with a third luminance, which is between the first and the second luminance, and then the variable luminance thereof is increased or decreased repeatedly and continuously in the range between the first luminance and the second luminance. The third luminance can be set as half of the maximum luminance, and in this way, if the control mode is switched to the luminance adjusting mode, the sudden luminance change of the LED module 10 would be moderate, which provides a preferable experience for a user.

Since the voltage waveform has the delayed conduction angle in each wave period after passing through the phase angle control module 16 while the switch 122 is being pressed, the processor 184*b* can calculate a length of time in which the switch 122 is being pressed by counting the number of the wave periods that has the delayed conduction angle in the voltage waveform, and the control mode can be switched by the processor 184*b* according to such information.

When the AC power source S is just conducted, and the switch 122 is not yet to be pressed (i.e. the input interface 12 is at the second state), the phase angle control module 16 doesn't modify the voltage waveform of the AC power source S, and therefore the phase angle detecting circuit 184*a* detects no delayed conduction angle in the voltage waveform. Meanwhile, the processor 184*b* controls the power conversion circuit 182 not to provide the electric signals to the LED module 10 to turn it off.

After the switch 122 is being pressed, the phase angle detecting circuit 184*a* detects that the voltage waveform has the delayed conduction angle, and the processor 184*b* calculates the length of time that the switch 122 is being pressed with the aforementioned method to switch the control mode accordingly.

If the length of time is shorter than a predetermined length of time, which is 1.2 seconds in the first preferred embodiment, the control mode is switched to the maximum illumination mode by the processor 184*b*, and therefore the LED module 10 emits light with the maximum luminance.

If the switch 122 is pressed again, and the length of time for this time is still shorter than the predetermined length of time, the control mode is switched to the default illumination mode by the processor 184*b*, and therefore the LED module emit light with the default luminance.

If the switch 122 is pressed yet again, and the length of time for this time is still shorter than the predetermined length of time, the processor 184*b* controls the power conversion circuit 182 not to provide the electric signals to the LED module 10, and therefore the LED module 10 is turned off.

If the default luminance needs to be updated, a user has to press the switch 122 for a while to let the length of time longer than the predetermined length of time. In such case, the control mode is switched to the luminance adjusting mode by the processor 184*b*, which allows the user to update the default luminance.

To apply the LED illumination system 1 with the aforementioned design to a building, the switch 122 and the phase angle control module 16 can be installed on walls of the building (i.e. installed at a control end), and the driving module 18 and the LED module 10 can be installed on the walls of a ceiling of the building (i.e. installed at a loading end). As a result, the phase angle control module 16 and the driving module 18 only need two wires, which are connected to the AC power source S, to connect each other. In other words, the driving module 18 is informed about which state the input interface 12 is at by the voltage waveform passing through the original wiring of the building, and therefore the driving module 18 is able to transmit corresponding electric signals to control the LED module 10.

In practice, the LED module 10 could include a plurality of first light sources, which are exemplified by a plurality of first LEDs, and a plurality of second light sources, which are exemplified by a plurality of second LEDs, wherein the light color of the first LEDs is different from that of the second LED. For example, the light color of the first LEDs is one of the cool colors, such as white or blue, and the light color of the second LEDs is one of the warm colors, such as yellow or red.

The power conversion circuit 182 of the riving module 18 respectively controls a luminance ratio of the first LEDs and the second LEDs, wherein the luminance ratio of the first LEDs is the ratio between a luminance of the first LEDs and the maximum luminance or the default luminance and the luminance ratio of the second LEDs is similar. The light color of the LED module 10 can be adjusted with different luminance ratios of the first LEDs and the second LEDs.

The processor 184*b* keeps a first luminance ratio information and a second luminance ratio information, wherein the first luminance ratio information and the second luminance ratio information respectively specify the luminance ratios of the first LEDs and the second LEDs when the control mode is under the maximum illumination mode and the default illumination mode.

The control mode stored in the processor 184*b* further includes a light color adjusting mode, which allows the first and the second luminance ratios to be adjusted. If the control mode is switched to the maximum illumination mode or the default illumination mode, the user can press the switch 122 longer than another predetermined length of time, which is 4 seconds in the first preferred embodiment, to switch the control mode to the light color adjusting mode.

Under the light color adjusting mode, the processor 184*b* controls the power conversion circuit 182 to drive the LED module 10 to emit light with a fixed luminance (i.e. the maximum luminance or the default luminance), and to tune the luminance ratios of the first and the second LEDs of the LED module 10 repeatedly, until the processor 184*b* finds out that the state of the input interface 12 is switched. The luminance ratios of the first and the second LEDs at this time point are recorded to update the first luminance ratio information of the maximum illumination mode or the second luminance ratio information of the default illumination mode, and the first and second LEDs are driven to emit light with the newly updated luminance ratios.

Whereby, the user is able to switch the control mode and adjust the luminance or the light color by simply pressing the switch 122 for a certain length of time.

Figure 3:
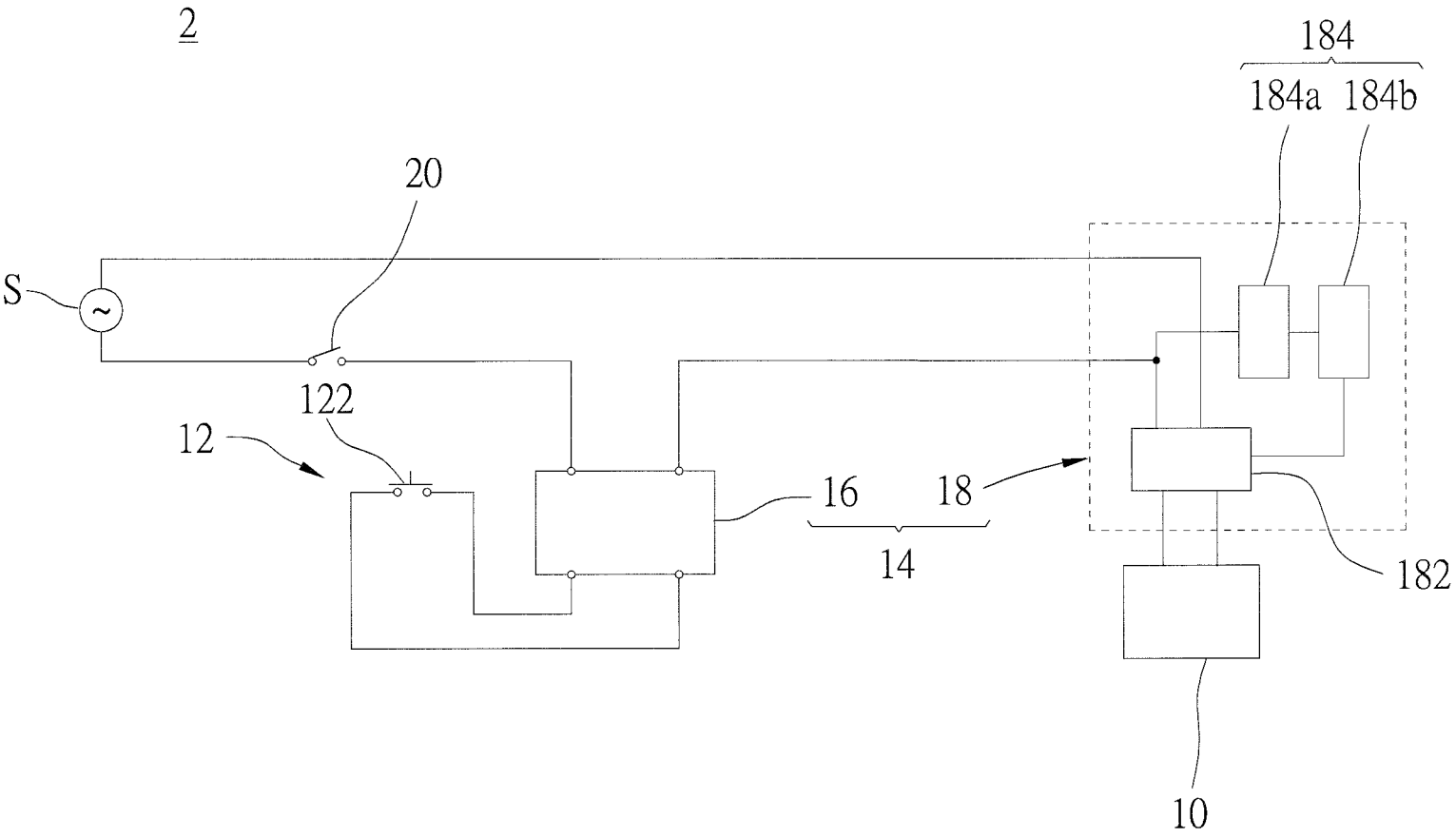
FIG. 3 is a block diagram of the illumination system of a second preferred embodiment of the present invention.

As shown in FIG. 3, a LED illumination system 2 of the second preferred embodiment of the present invention is based on the first preferred embodiment, but further has a change-over switch 20, which is electrically connected to the AC power source S and the phase angle control module 16. The change-over switch 20 is provided to turn on or off the LED module 10.

In the second preferred embodiment, when the change-over switch 20 is conducted, the control mode is switched to the maximum illumination mode by the processor 184*b* of the driving module 18, and therefore the LED module 10 emit light with the maximum luminance. Similarly, by pressing the switch 122 longer or shorter, the control mode can be switched between the default illumination mode, the maximum illumination mode, the luminance adjusting mode, and the light color adjusting mode by the processor 184*b*.

Figure 4:
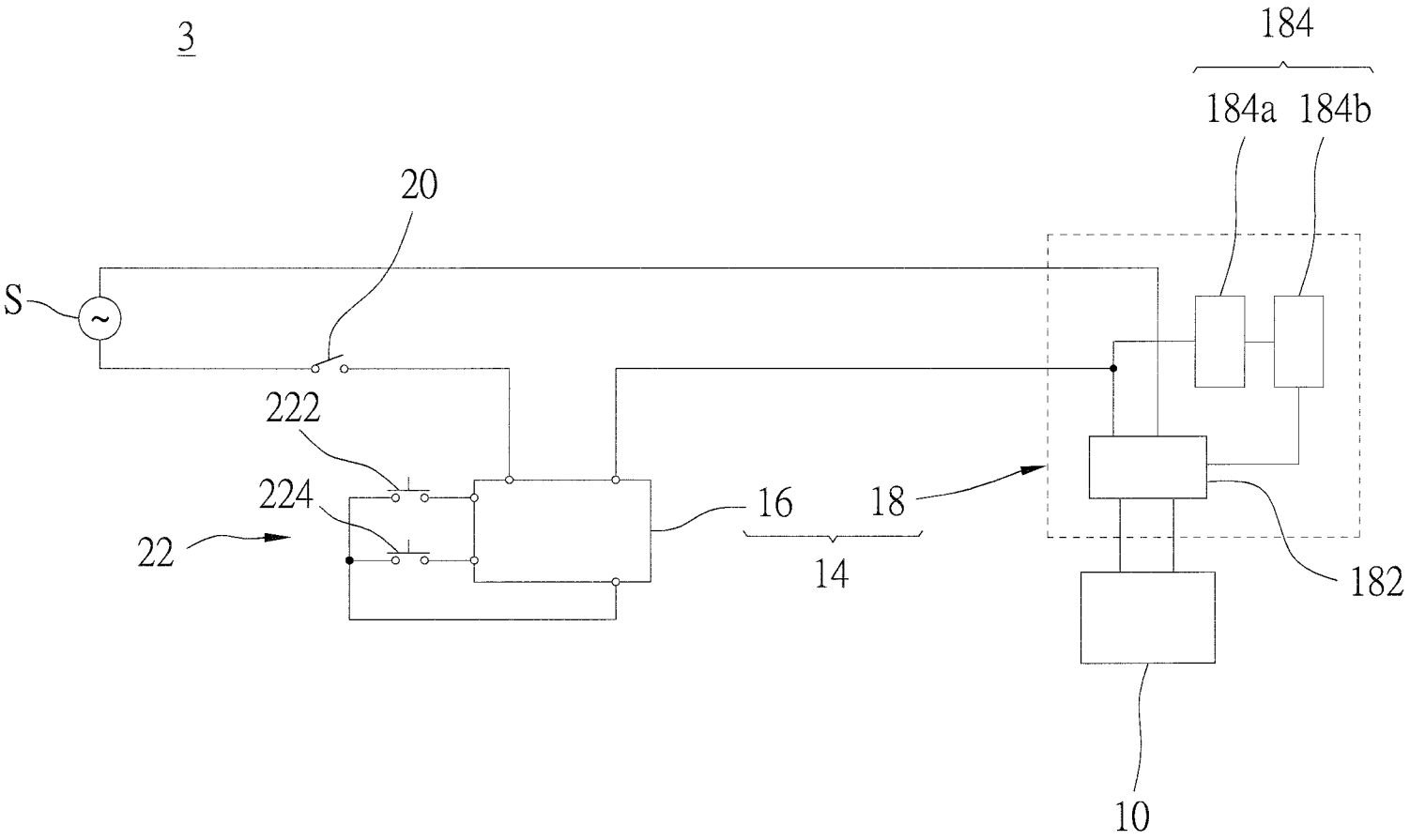
FIG. 4 is a block diagram of the illumination system of a third preferred embodiment of the present invention.

As shown in FIG. 4, a LED illumination system 3 of the third preferred embodiment of the present invention is based on the aforementioned embodiments, but the input interface 22 includes two switches 222, 224, which are electrically connected to the phase angle control module 16. If each switch 222, 224 is pressed and therefore short, the phase angle control module 16 makes the voltage waveform of the AC power source S to have the delayed conduction angle in its positive half-wave periods. With different switches 222, 224 being pressed, a degree of the delayed conduction angle is different. Whereby, the phase angle detecting circuit 184*a* can find out which switch 222, 224 is pressed by measuring the degree of the delayed conduction angle, and the processor 184*b* can switch the control mode accordingly.

For example, the control mode can be switched between the maximum illumination mode and the default illumination mode by pressing the switch 222 shorter than the predetermined length of time, and can be switched to the luminance adjusting mode by pressing the switch 222 longer than the predetermined length of time.

The processor 184*b* is further stored with a plurality of default light colors, and each default light color corresponds to one of the luminance ratios of the first and the second LEDs. If the control mode is switched to the maximum illumination mode or the default illumination mode, one of the default light colors can be selected by shortly pressing the switch 224. The first luminance ratio information or the second luminance ratio information is updated according to the selected default light color, and the first and the second LEDs are driven to emit light with the newly updated luminance ratio.

In addition, if the control mode is switched to the maximum illumination mode or the default illumination mode, it can be switched to the light color adjusting mode by pressing the switch 224 for a while.

Figure 5:
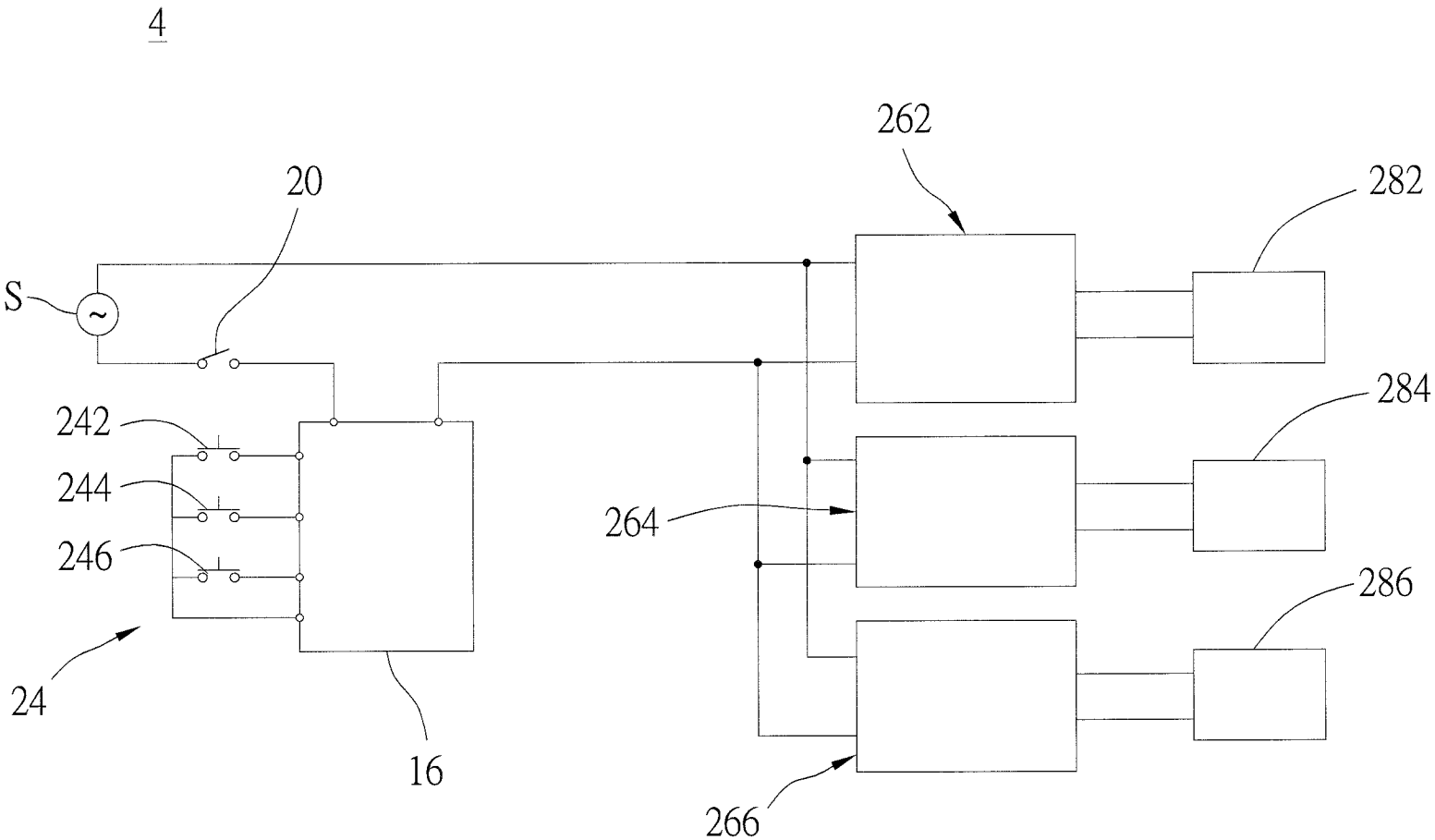
FIG. 5 is a block diagram of the illumination system of a fourth preferred embodiment of the present invention.

As shown in FIG. 5, a LED illumination system 4 of the fourth preferred embodiment of the present invention has roughly the same design with the aforementioned embodiments, except that the input interface 24 includes three switches 242, 244, 246, which are electrically connected to the phase angle control module 16. With different switches 242, 244, 246 being pressed, the phase angle control module 16 makes the degree of the delayed conduction angle different. In addition, the LED illumination system 4 includes three driving modules 262, 264, 266, and three LED modules 282, 284, 286, wherein each driving module 262, 264, 266 corresponds to a specific degree of the delayed conduction angle. In other words, each driving module 262, 264, 266 corresponds to each case that one of the switches 242, 244, 246 is pressed, and each LED module 282, 284, 286 is controlled accordingly.

For example, if the switch 242 is pressed, the driving module 262 measures the corresponding degree of the delayed conduction angle and calculates the length of time of the pressing to control the LED module 282.

Of course, there could be more than three switches contained in the input interface 24 in other embodiments. In such cases, there should be driving modules and LED modules with corresponding number provided at the loading end, and the multiple LED modules can still be controlled at the control end.

Figure 6:
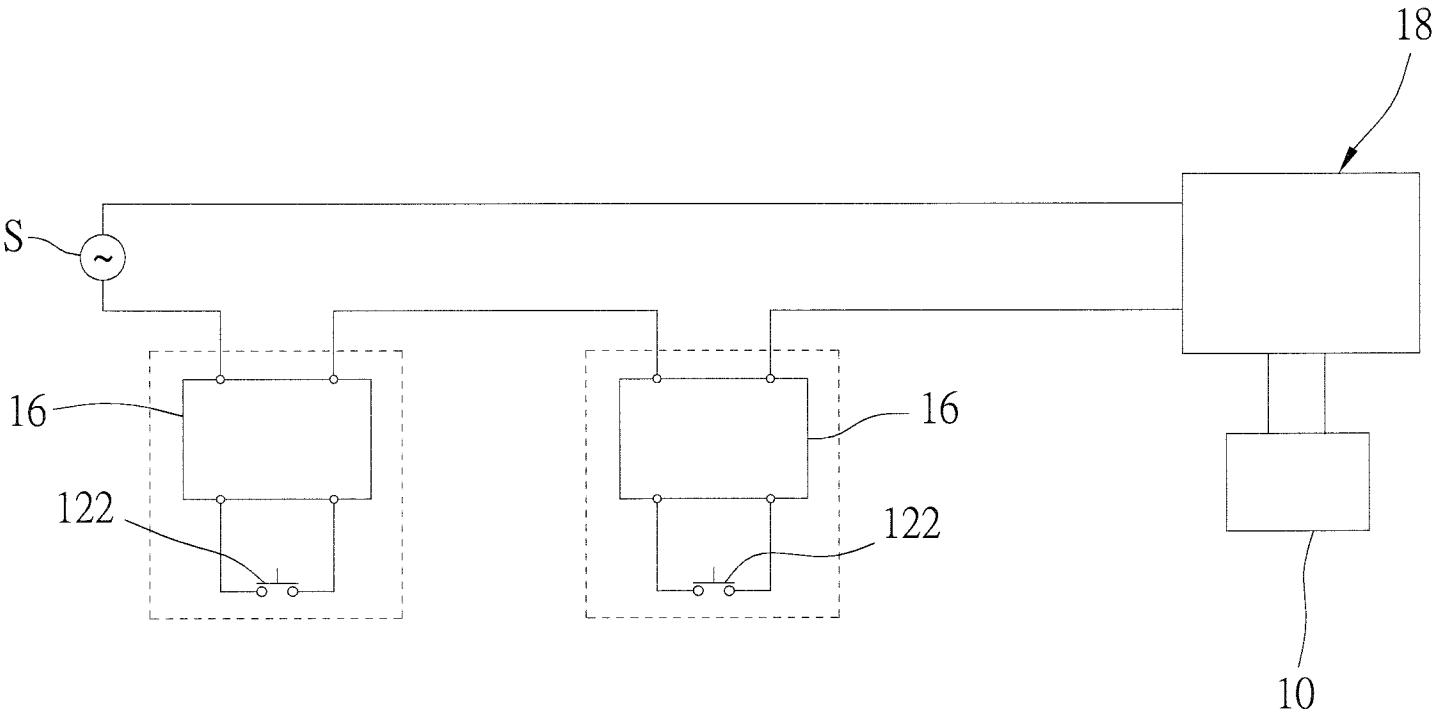
FIG. 6 is a block diagram of the illumination system of a fifth preferred embodiment of the present invention.
Figure 7:
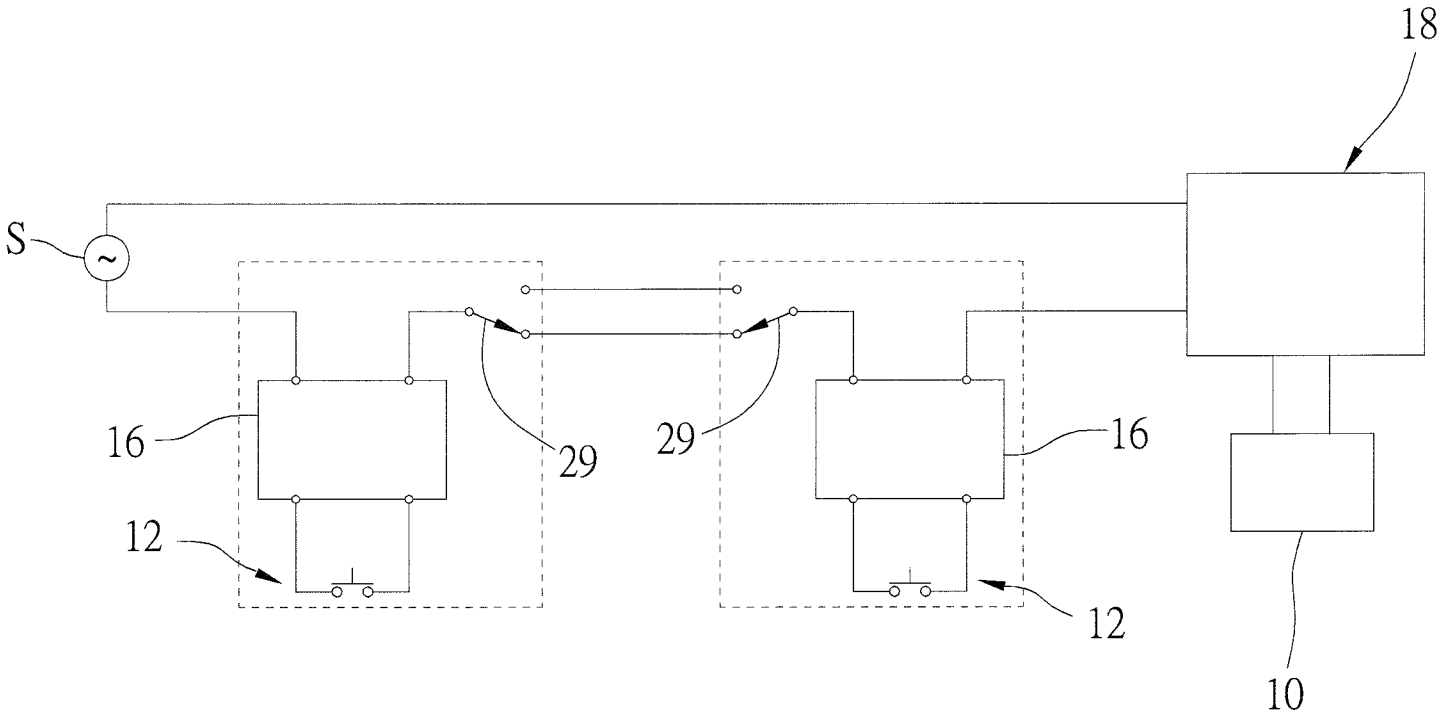
FIG. 7 is a block diagram of the illumination system of a sixth preferred embodiment of the present invention.
Figure 8:
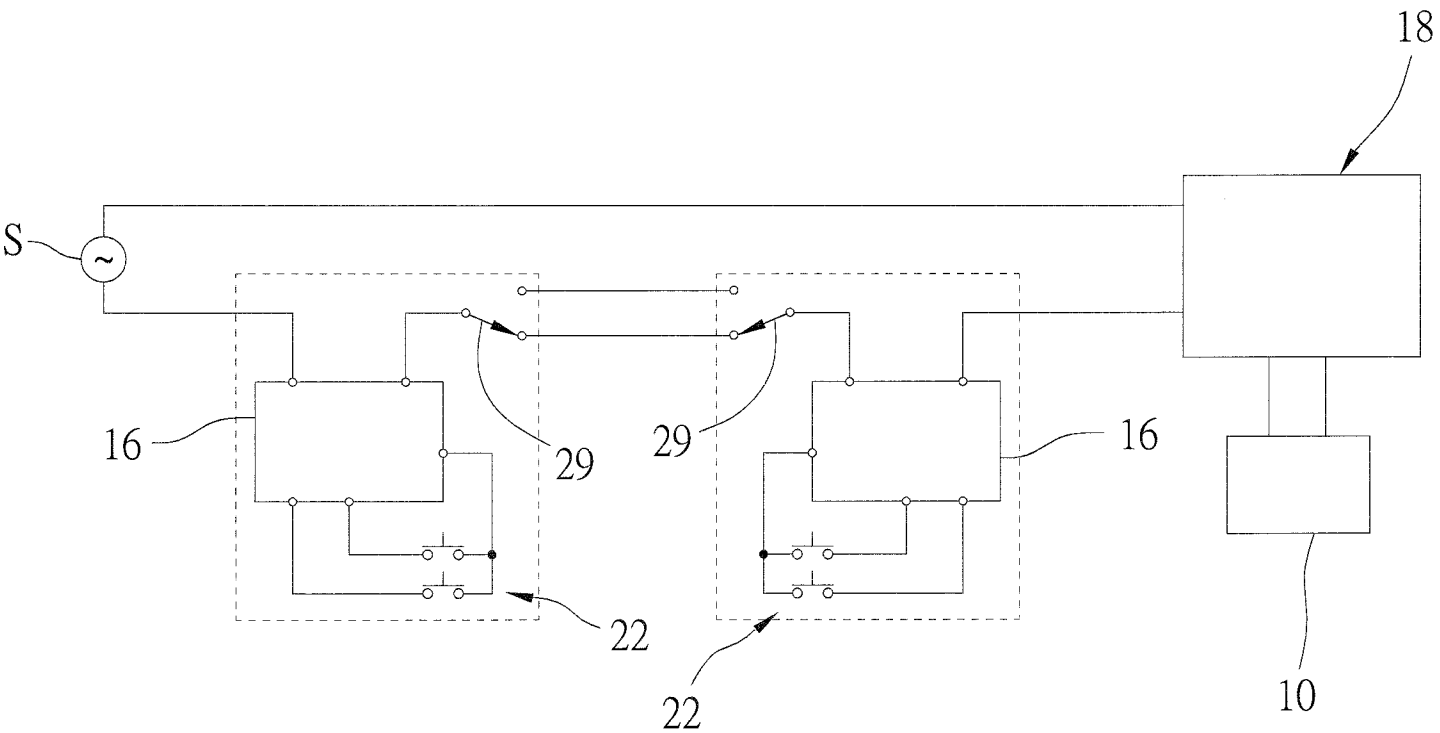
FIG. 8 is a block diagram of the illumination system of a seventh preferred embodiment of the present invention.
Figure 9:
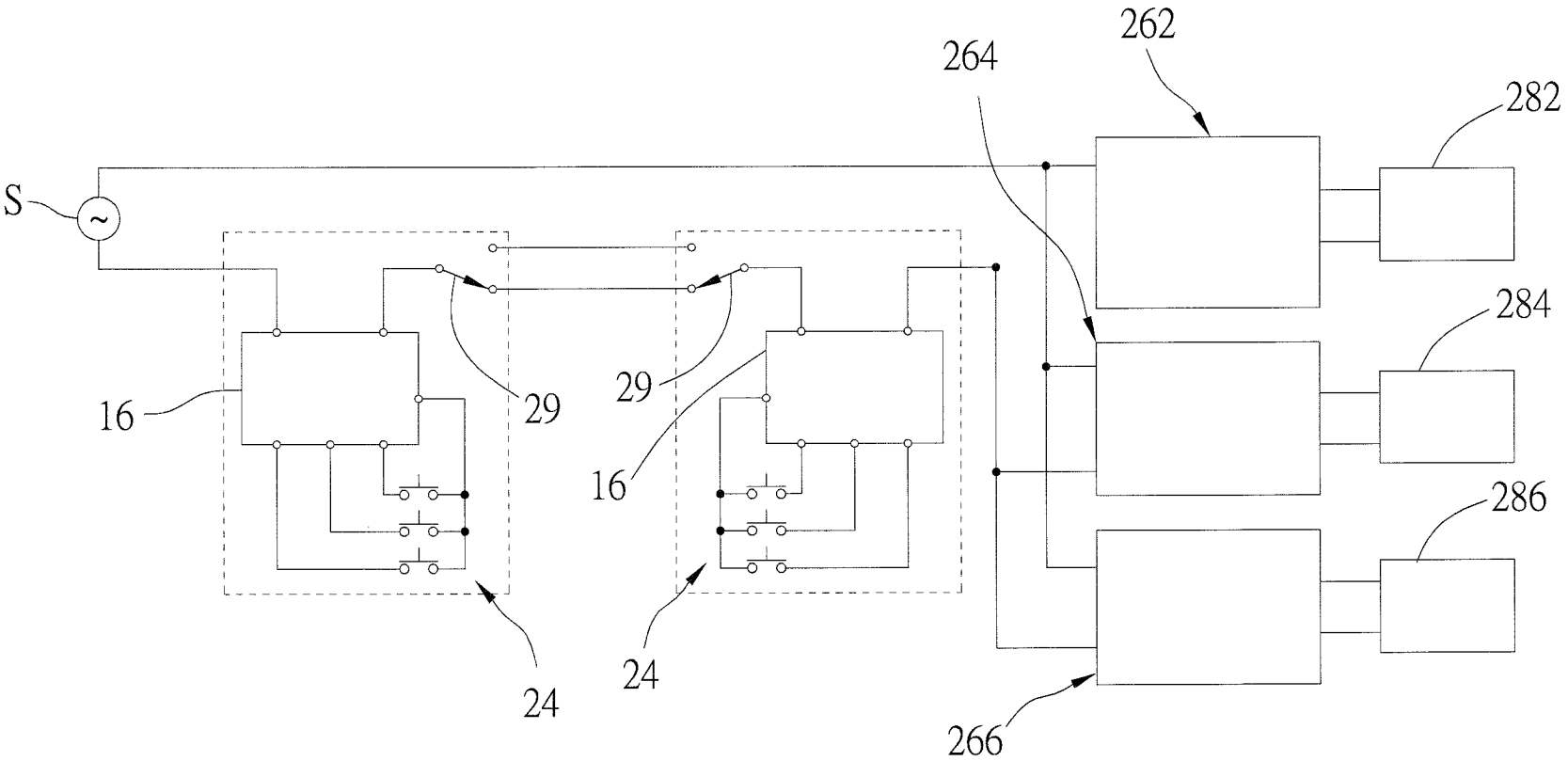
FIG. 9 is a block diagram of the illumination system of an eighth preferred embodiment of the present invention.

Besides, in order to fit the pattern of a building, the LED illumination system 1 of the first embodiment can be modified to be the fifth preferred embodiment shown in FIG. 6, wherein there are two phase angle control modules 16 and two switches 122 installed at different locations in the building for the user to control the LED module 10. Based on the same idea, the second, third, and fourth LED illumination system 2, 3, 4 can be modified to be the sixth, seventh, and eighth preferred embodiments respectively shown in FIGS. 7, 8, and 9, wherein there are two three-way switches 29, two phase angle control modules 16, and two input interfaces 12, 22, 24 installed at different locations in the building for the user to control the LED module 10.

Figure 10:
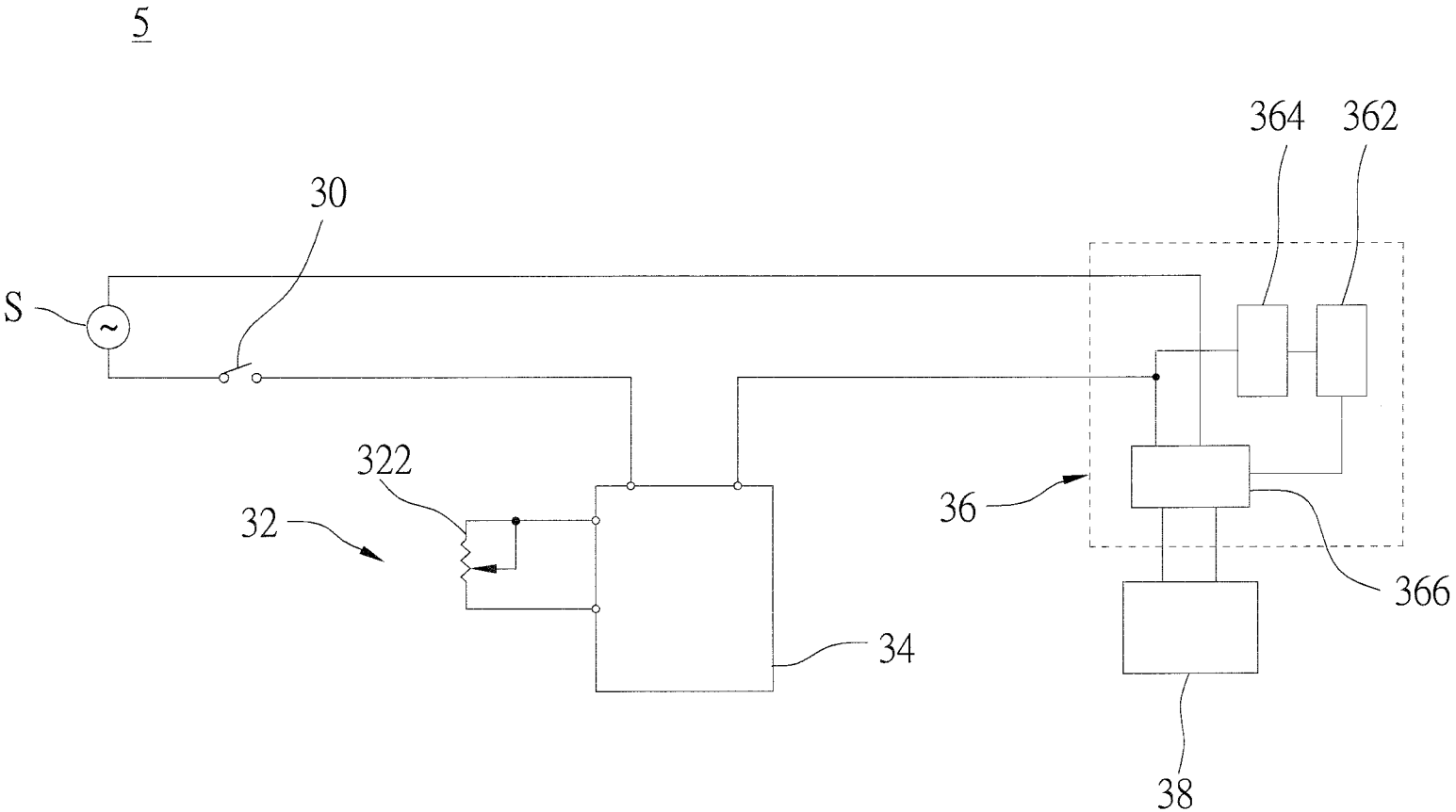
FIG. 10 is a block diagram of the illumination system of a ninth preferred embodiment of the present invention.

As shown in FIG. 10, a LED illumination system 5 of the ninth preferred embodiment of the present invention includes a change-over switch 30, an input interface 32, a phase angle control module 34, a driving module 36, and a LED module 38. The input interface 32 includes an adjustable resistor 322 electrically connected to the phase angle control module 34. With different resistance of the adjustable resistor 322, the degree of the delayed conduction angle is different. In the ninth preferred embodiment, the degree of the delayed conduction angle increases along with the increment of the resistance of the adjustable resistor 322, and the delayed conduction angle is always greater than zero degree, even if the resistance of the adjustable resistor 322 is adjusted to be zero Ohm. In other words, after the voltage waveform passing through the phase angle control module 34, the delayed conduction angle always exits within.

The processor 362 of the driving module 36 obtains the resistance of the adjustable resistor 322 by measuring the degree of delayed conduction angle with the phase angle detecting circuit 364, and the power conversion circuit 366 transmits the electric signals to the LED module 38 accordingly to the resistance. For example, the luminance or the light color of the LED module 38 can be adjusted with different resistance.

Each LED illumination system in the aforementioned embodiments is merely an example for explaining the method of transmitting signals of the present invention, and the method can be applied to other loading control systems, such as motor control systems. In such cases, a motor can be controlled by switching an input interface to different states at a control end with the help of a phase signal transmitter. In addition, other loadings such as bathroom heaters, exhaust fans, ceiling fans, or other electric products may be also controlled in this way.

Figure 11:
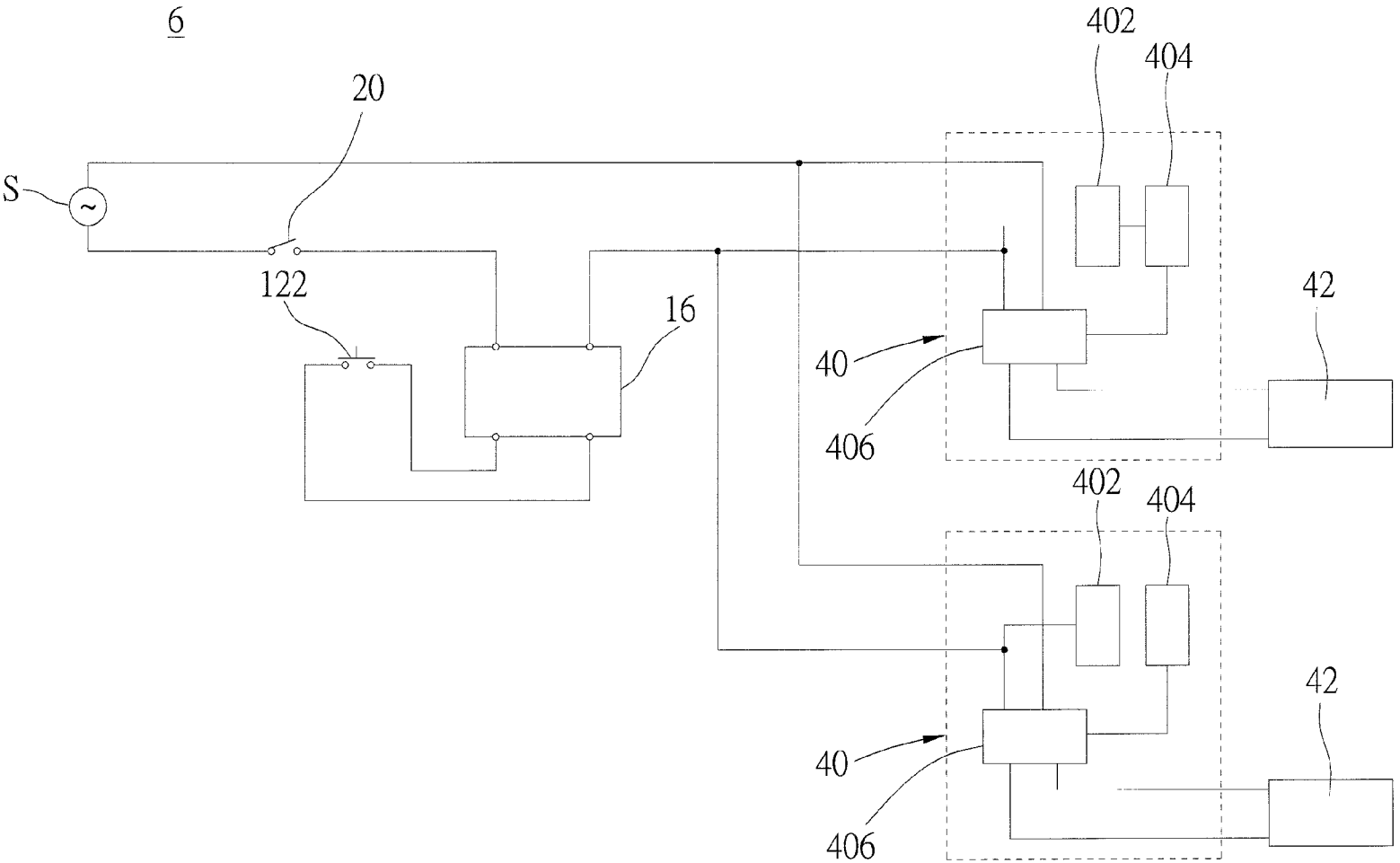
FIG. 11 is a block diagram of the illumination system of a tenth preferred embodiment of the present invention.

As shown in FIG. 11, an illumination system 6 of the tenth preferred embodiment of the present invention has basically the same structure with the second preferred embodiment, which includes a plurality of driving modules 40 and a plurality of LED modules 42 which are respectively paired with the driving modules 40. Each of the driving modules 40 includes a phase angle detecting circuit 402, a processor 404, and a power conversion circuit 406. Each pair of the driving modules 40 and the LED modules 42 is installed at different locations in a house. The user can use the change-over switch 20 to simultaneously control the driving modules 40 to turn on or off the paired LED modules 42. The processor 404 of each of the driving modules 40 simultaneously switches a control mode by pressing the switch 122 with a predetermined length of time and counts, wherein the control mode includes the maximum illumination mode, the default illumination mode, and the luminance adjusting mode for example.

Take one of the driving modules 40 for explanation, if the control mode is switched to the luminance adjusting mode by the processor 404 thereof, the processor 404 controls the power conversion circuit 406 thereof to drive the paired LED module 42 to emit light with a variable luminance which is repeatedly and continuously regulated between a first luminance and a second luminance until the processor 404 finds the switch 122 is switched to a different state. At this time point, the variable luminance of the LED module 42 stops being regulated, and is recorded to update a default luminance, as described in the previous embodiments.

In practice, there may be timing errors among the processors 404 due to several reasons, such as differences in manufacturing process, temperature fluctuations, unstable voltages, or interference of other noises. Therefore, if the control mode is switched to the luminance adjusting mode, time points for the processors 404 to respectively control the paired LED module 42 may somewhat inconsistent. The longer the variable luminance of each of the LED modules 42 is repeatedly and continuously regulated, the more obvious luminance differences would be seen among the LED modules 42. Consequently, each of the processors 404 may record different variable luminance when the switch 122 is switched to another state, which causes the LED modules 42 to emit light with different default luminance.

To avoid the aforementioned problem, the tenth preferred embodiment further provides a synchronization mechanism for the luminance adjusting mode, whereby each of the processors 404 can simultaneously control the corresponding power conversion circuit 406. For each of the driving modules 40, the processor 404 thereof is able to obtain cycles of the voltage waveform of the AC power source S by detecting the voltage waveform which passes through the phase angle control module 16 with the phase angle detecting circuits 402 thereof. A reference point is defined in each cycle of the voltage waveform for the purpose of synchronization. In the tenth preferred embodiment, the reference point is a first zero crossing point of each cycle. Every time the processor 404 detects the reference point, it controls the power conversion circuit 406 to drive the paired LED module 42 to increase or decrease by a luminance difference.

For example, if the first luminance is 100, the second luminance is 10, and the luminance difference is 1, after the control mode is switched to the luminance adjusting mode, each of the processors 404 controls the corresponding power conversion circuit 406 to drive the paired LED module 42 to emit light with the variable luminance of 100 at the first zero crossing point of the first cycle of the voltage waveform. The variable luminance is decreased by the luminance difference, which is 1, at the first zero crossing point of each of the following cycles, until the variable luminance becomes 10. And then the variable luminance is increased by the luminance difference, which is also 1, until the variable luminance becomes 100 again, and so on. The variable luminance is regulated between the first luminance and the second luminance repeatedly and continuously in this way.

Whereby, all processors 404 are guaranteed to regulate the variable luminance at the same time point, which effectively ensures that the LED modules 42 have consistent luminance adjusting processes. In practice, the reference point can be two zero crossing points in each cycle of the voltage waveform. Of course, peak of the voltage waveform can be the reference point too.

In practice, each of the LED modules 42 includes a plurality of first LEDs and a plurality of second LEDs, wherein light color of the first LEDs is different from that of the second LED. The control mode stored in each of the processors 404 further includes a light color adjusting mode, wherein the light color adjusting mode is provided for adjusting light color of each of the LED modules 42. If the control mode stored in each of the processors 404 is switched to the light color adjusting mode, again, the voltage waveform of the AC power source S can be seen as the basis of synchronization. In other words, each of the processors 404 adjusts luminance ratio between the first LEDs and the second LEDs of the paired LED module 42 at the reference point in each cycle. As a result, all of the LED modules 42 can adjust the light color thereof at the same time, which prevents the light colors of the LED module 42 from being different.

The LED module in the aforementioned preferred embodiments is taken as an example for explaining the illumination systems and the phase signal transmitters provided in the present invention. In other embodiments, the LED module can be replaced by other kinds of lamps, such as fluorescent lamp or discharge lamp, which can also be driven by applying a corresponding power conversion circuit.

With such design, the state of the input interface at the control end is transmitted to the loading end through the phase signal transmitter, and the electric signals corresponding to the state of the input interface is generated to control the loading. In other words, the signals are transmitted by means of the voltage waveform of the AC power source, and therefore it is not necessary to install additional wiring or apparatuses for wireless transmission, which effectively reduces the cost of wiring.

It must be pointed out that the embodiments described above are only some preferred embodiments of the present invention. All equivalent structures which employ the concepts disclosed in this specification and the appended claims should fall within the scope of the present invention.

What is claimed is:

1. An illumination system, comprising:

an input interface, which is controllably switched between a first state and a second state;

a phase angle control module electrically connected to an AC power source and the input interface, wherein when the input interface is at the first state, the phase angle control module modifies a voltage waveform of the AC power source to generate a delayed conduction angle in a half wave period of the voltage waveform of the AC power source;

a lamp, which is controllable to emit light; and a driving module electrically connected to the phase angle control module and the lamp, wherein the driving module is stored with a control mode, which includes a default illumination mode and a luminance adjusting mode, and the driving module switches the control mode in accordance with the delayed conduction angle generated by the phase angle control module; if the control mode is switched to the default illumination mode, the lamp is driven to emit light with a default luminance; if the control mode is switched to the luminance adjusting mode, the lamp is driven to emit light with a variable luminance which is repeatedly and continuously regulated between a first luminance and a second luminance until the input interface is switched again, wherein the variable luminance at this time point of the input interface being switched is recorded to update the default luminance, and then the lamp is driven to emit light with the newly updated default luminance.

2. The illumination system of claim 1, wherein when the input interface is at the second state, the phase angle control module does not modify the voltage waveform of the AC power source, and therefore the delayed conduction angle is not generated in the half wave period of the voltage waveform.

3. The illumination system of claim 2, wherein the input interface includes a switch, which is a normally open push switch; the switch is at the first state while being pressed to be short, and the switch is automatically switched back to the second state once not pressed.

4. The illumination system of claim 3, wherein the input interface includes a plurality of the switches; with different switches being pressed, the phase angle control module makes a degree of the delayed conduction angle different; the driving module switches the control mode in accordance with the degree of the delayed conduction angle.

5. The illumination system of claim 1, wherein the driving module includes a power conversion circuit, a phase angle detecting circuit, and a processor which are electrically connected to each other; the power conversion circuit is electrically connected to the phase angle control module and the lamp to convert power provided by the AC power source which passes through the phase angle control module into electric signals to drive the lamp; the phase angle detecting circuit is electrically connected to the phase angle control module to detect the delayed conduction angle; the control mode is stored in the processor; the processor switches the control mode in accordance with the delayed conduction angle detected by the phase angle detecting circuit, and controls the power conversion circuit to drive the lamp to emit light.

6. The illumination system of claim 5, wherein when the control mode is switched to the luminance adjusting mode, the variable luminance is first set as a third luminance which is between the first and the second luminance, and then starts to be regulated.

7. The illumination system of claim 5, further comprising a plurality of the lamps and a plurality of the driving modules, wherein for each of the driving modules, the phase angle detecting circuit thereof further detects the voltage waveform which passes through the phase angle control module, and if the control mode stored therein is switched to the luminance adjusting mode by the processor thereof, the processor thereof drives the corresponding lamp to emit light with the variable luminance which is increased or decreased by a luminance difference a-t-at least one reference point in each cycle of the voltage waveform detected by the phase angle detecting circuits thereof.

8. The illumination system of claim 7, wherein the at least one reference point is a zero crossing point in the each cycle of the voltage waveform detected by the phase angle detecting circuit of each of the driving modules.

9. The illumination system of claim 7, wherein the at least one reference point is a peak in the each cycle of the voltage waveform detected by the phase angle detecting circuit of each of the driving modules.

10. The illumination system of claim 1, wherein when the control mode is switched to the luminance adjusting mode, the variable luminance is first set as a third luminance value which is between the first and the second luminance, and then starts to be regulated.

11. The illumination system of claim 7, wherein the control mode further includes a maximum illumination mode; if the control mode is switched to the maximum illumination mode, the lamp is driven to emit light with a maximum luminance, which is a highest luminance achievable for the lamp to be operated under a rated power thereof.

12. The illumination system of claim 1, wherein the lamp includes a plurality of first light sources and a plurality of second light sources; a light color of the first light sources is different from that of the second light sources; the default illumination mode includes a luminance ratio information which records luminance ratios of the first and the second light sources if the control mode is switched to the default illumination mode; the luminance ratios are respectively ratios of a luminance of the first and the second light sources to the default luminance; the control mode further includes a light color adjusting mode; if the control mode is switched to the light color adjusting mode, the lamp is driven to emit light with the default luminance, and to tune the luminance ratios of the first light sources and the second light sources repeatedly and continuously until the input interface is switched again, wherein the luminance ratios of the first and the second light sources at this time point of the input interface being switched are recorded to update the luminance ratios included in the luminance ratio information, and then the first and the second light sources are driven to emit light respectively with the newly updated luminance ratios.

13. The illumination system of claim 1, wherein the delayed conduction angle is less than or equal to 90 degrees.

14. The illumination system of claim 1, wherein the delayed conduction angle is generated at a positive half-wave of the voltage waveform of the AC power source.

15. The illumination system of claim 1, wherein the input interface includes a switch, which is a normally open push switch; the switch is at the first state while being pressed to be short, and the switch is automatically switched back to the second state once not pressed.

16. The illumination system of claim 15, wherein the input interface includes a plurality of the switches; with different switches being pressed, the phase angle control module makes a degree of the delayed conduction angle different; the driving module switches the control mode in accordance with the degree of the delayed conduction angle.

17. A phase signal transmitter, which is provided between an AC power source and a lamp, comprising:

a switch, which is controllably switched between a short state and an open state;

a phase angle control module electrically connected to the AC power source and the switch, wherein when the switch is at the short states, the phase angle control module modifies a voltage waveform of the AC power source to generate a delayed conduction angle in a half wave period of the voltage waveform of the AC power source; when the switch is at the open states, the delayed conduction angle is not generated in the voltage waveform; and a driving module electrically connected to the phase angle control module and the lamp, wherein the driving module generates electrical signals to control the lamp to emit light in accordance with the delayed conduction angle generated by the phase angle control module.

18. A phase signal transmitter, which is provided between an AC power source and a lamp, comprising:

an adjustable resistor, which is controllable to adjust a resistance thereof;

a phase angle control module electrically connected to an AC power source and the adjustable resistor, wherein the phase angle control module modifies a voltage waveform of the AC power source to generate a delayed conduction angle in a half wave period of the voltage waveform of the AC power source in accordance with the resistance of the adjustable resistor, and the delayed conduction angle has different degrees in accordance with different resistance of the adjustable resistor; and a driving module electrically connected to the phase angle control module and the lamp, wherein the driving module generates electrical signals to control the lamp to emit light in accordance with the degree of the delayed conduction angle generated by the phase angle control module.

* * * * *